US006208301B1

(12) United States Patent
Sandgren et al.

(10) Patent No.: US 6,208,301 B1
(45) Date of Patent: Mar. 27, 2001

(54) ANTENNA DEVICE

(75) Inventors: Anders Sandgren, Djursholm; Magnus Bjornberg; Ulf Palin, both of Ljustero; Carl Jonasson, Stockholm, all of (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/477,018

(22) Filed: Jan. 3, 2000

Related U.S. Application Data

(63) Continuation of application No. 09/007,812, filed on Jan. 15, 1998, now abandoned.

(51) Int. Cl.[7] ..... H01Q 1/24
(52) U.S. Cl. ..... 343/702; 455/90
(58) Field of Search ..... 343/702; 455/575, 455/90

(56) References Cited

U.S. PATENT DOCUMENTS 2,366,634 * 1/1945 Ludwig ..... 343/702
5,469,177 * 11/1995 Rush et al. ..... 343/702
5,686,927 * 11/1997 Simmons ..... 343/702

FOREIGN PATENT DOCUMENTS 0634806 1/1995 (EP) .
WO94/10720 5/1994 (WO) .
WO94/28593 12/1994 (WO) .

* cited by examiner

*Primary Examiner*—Don Wong
*Assistant Examiner*—James Clinger
(74) *Attorney, Agent, or Firm*—Jacobson, Price, Holman & Stern, PLLC

(57) ABSTRACT

An antenna device (1) for portable communication equipment and comprising an extendable elongated antenna element (2) which at its lower part comprises a peg element (6) and which is slidable inside a sleeve (5) between an extended position and a retracted position, wherein the sleeve (5) is rigid and the peg element (6) is provided with a resilient engagement portion at a free end of the peg element, said sleeve (5) on the inside being provided with an abutment (9) for co-operation with a corresponding shoulder (9') on the elongated antenna element (6), said shoulder being located between the contact surface and the upper end of the elongated antenna element.

36 Claims, 2 Drawing Sheets

ANTENNA DEVICE

This application is a continuation of Ser. No. 09/007,812 filed Jan. 15, 1998, abandoned.

BACKGROUND OF THE INVENTION

1. Field of the Invetion

This invention concerns an antenna device for portable communication equipment and comprising an extendable elongated antenna element which at its lower part comprises a peg element and which is slidable inside a sleeve member between an extended position, where the peg element is mechanically locked in the sleeve member and where simultaneously conductive contact between the sleeve member and the elongated antenna element is established, and a retracted position. The invention also concerns a stopper to be included in the above antenna device.

Such an antenna device is previously known from WO 94/28593, wherein an antenna rod at its lower region is provided with a rigid stopper element which, in the extended position, cooperates with a resilient sleeve member so as to obtain a locking force between these parts.

2. Summary of the Invention

The prior art device is well functioning, however, relatively space-demanding in the axial direction, since the sleeve construction necessarily have relatively large axial dimensions and because the end portion of the stopper element appearing on the outside of the sleeve in the extended position. Further, the prior art solution includes several separate details such as a sleeve, a spring ring for the sleeve, a screw portion and a stopper element, resulting in correspondingly high costs for manufacture, on the one hand of the separate elements and on the other hand for assembly of the elements. The use of several elements also result in accumulated and more widely spread tolerances.

It is an aim of this invention to provide an antenna device of the above mentioned type wherein the prior art problems are eliminated or at least reduced.

This aim is achieved by the peg element being provided with a resilient portion including at least one engagement portion having a contact surface which in the extended position of the antenna rod exerts a locking force against the sleeve member, said engagement portion being provided on a free end of the peg element opposite the antenna rod, and said sleeve member on the inside being provided with an abutment for co-operation, in the extended position of the elongated antenna element, with a corresponding shoulder thereon, said shoulder being located between the contact surface and the upper part of the elongated antenna element.

This way the mutually operating elements—the peg and the sleeve—may simply be constructed as only two elements, thus reducing costs for production and assembly. The sleeve member may be substantially rigid, and therefore it may be produced with reduced dimensions which is of crucial importance in portable communication equipment of today. The aim of space reduction is further achieved by locating the shoulder above the contact surface which is placed at the free end portion of the peg, thus minimizing the axial dimensions of the peg element and consequently of the device as a whole in comparison with the prior art.

Further important features of the invention are reduced weight, possibility of reducing antenna length and reliability.

By providing the resilient portion with one or more bifurcating slot(s) which is (are) arranged in parallel with the axis of the peg element, the resiliency of the resilient portion is easily obtained.

By the contact surface being convex or rounded, i.e. curved in two perpendicular directions, it is assured that the pulling force variation is minimized and this provision also results in a smooth movement when the extended position is established. By the surface being substantially spherical it is achieved that the desired holding force will be obtained also if the peg axis is not perfectly aligned with respect to the sleeve axis.

In an embodiment where the sleeve is cylindrical inside for frictional engagement with the engagement portion(s) a smooth locking action is accomplished and uncomplicated manufacture.

In a preferred aspect of the invention each engagement portion is provided on an axially extended spring acting shank element. This way it is achieved that the looking force exerted by the engagement portion(s) is easily controlled, also with regard to the manufacturing tolerances which otherwise could result in a substantial variation of the locking force and thereby of the pulling force applied to the elongated antenna element by a user for establishing the extended position. This is because the extended shank element which acts as a spring provides limited variation of the engagement force over a reasonable range of the travel length for the engagement portion(s) within which range the manufacturing tolerances are easily included. This feature provides for efficient manufacture and reduces the needs for testing and controlling the function of the finished antenna device and, very important, radically reduces rejection problems. The device according to this aspect of the invention is thus well adapted for production in large series since the control need is eliminated or at least reduced to a minimum. Miniaturization is also made achievable since it provides for controlled forces even though the elements have reduced dimension. As an example it could be mentioned that the diameter of the engagement portion in a particular embodiment is about 2.5 mm.

By the use of a tapering shank element the stress distribution along its length may be optimized and the peg weight further reduced.

By providing the sleeve with a threaded portion for cooperation with a piece of equipment the need for a separate threaded element is eliminated.

Further advantages are clear from the following detailed description of an embodiment and with reference to the drawings, wherein:

DESCRIPTION OF THE INVENTION

Figure 1:
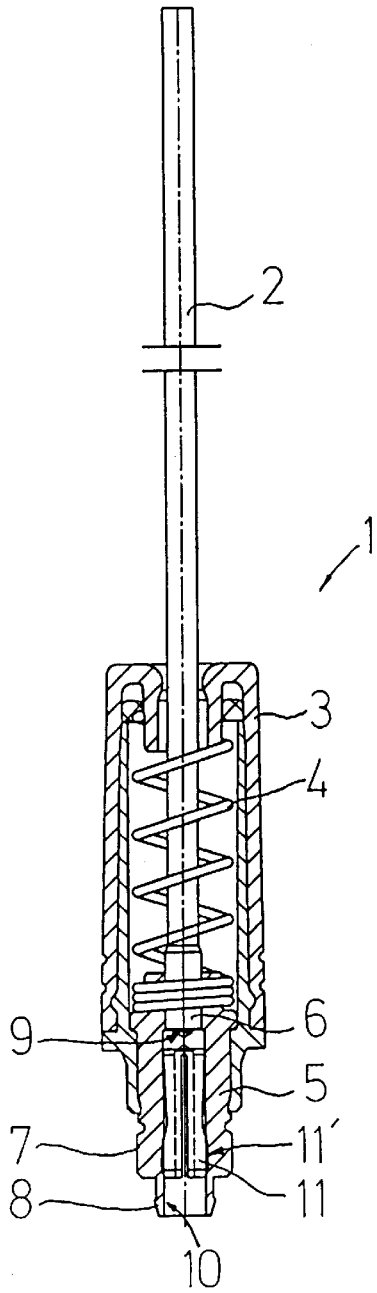
FIG. 1 shows an antenna assembly for a portable communication device according to the invention.

The embodiment of FIG. 1 concerns an extendable antenna device 1, wherein an extendible antenna rod 2 is slidable inside a casing 3 of a helical antenna 4. At the bottom part of casing 3 a sleeve member 5 is partly enclosed which on the one hand provides for attachment onto a piece of portable communication equipment, mechanically as well as electrically (for signal transfer) and on the other hand provides a seat for a stopper or a peg element 6, which is attached to the lower part of the rod 2. At its lower region the sleeve member 5 comprises a threaded portion 7 for threaded engagement with the portable piece of communication equipment and finally a signal coupling portion 8 at the extreme lower end of the sleeve member 5. The number 9 indicates co-operating portions: an abutment on the inside of the sleeve member 5 and a shoulder on the peg element so as to obtain a defined extended position for the rod 2. The inside surface 10 of the sleeve member 5 is circular cylindrical so that co-operation with a contact surface 11' on engagement elements 11, which are parts of an engagement portion which in turn is provided at the lower end portion of the peg element 6, result in only frictional engagement therebetween. At the same time, since the peg element 6 is mechanically locked inside the sleeve member 5 galvanic contact between the sleeve member and the peg element and thus the antenna rod 2 is achieved in order to appropriately transmit signals to and from the antenna rod.

Figure 2A:
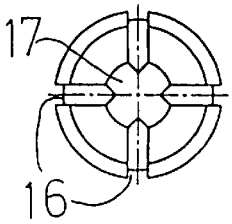
FIG. 2*a* shows the peg element in a bottom view, and FIG. 3 illustrate a comparison between an assembly according to the invention and assembly according to the prior art with respect to space demand.
Figure 2:
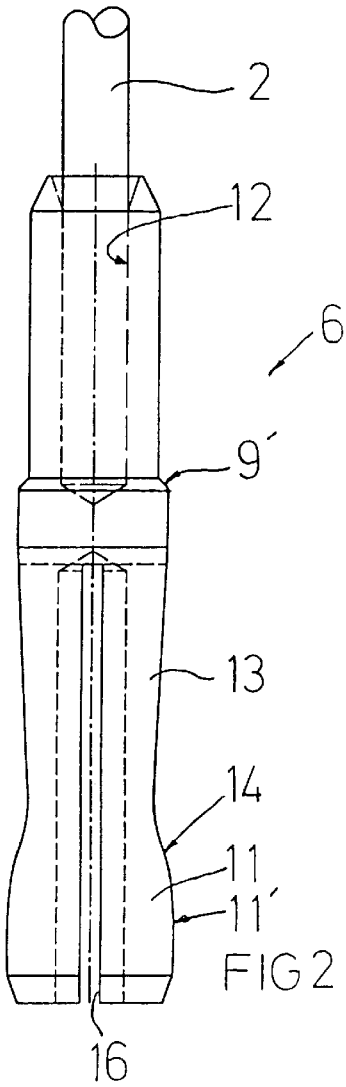
FIG. 2 shows in a side view a peg element for use in an antenna device according to the invention in an enlarged scale.

At its upper portion the peg member of FIG. 2 is provided with a bore 12 for receiving the lower part of the antenna rod 2, said upper portion having a reduced outside diameter with respect to the shoulder 9'. Fastening of the rod inside the hole 12 could be achieved by i.a. pressing or soldering. The engagement elements 11 of the engagement portion are provided with rounded entering surface 14 in order to secure smooth entry into the sleeve member (see FIG. 1). Further the contact surface 11' is rounded and preferably part-spherical so as to allow a certain misalignment of the peg with respect to the sleeve and still obtain the desired locking properties.

Each engagement element 11 is supported on an axially directed elongated shank element 13 so as to provide substantially equal locking force within the range of the manufacturing tolerances. As a preferred example the ratio between the free shank length and the radius of the resilient portion is between about 1.5–4.

In particular the resilient portion is manufactured by providing the lower portion of the peg element with two slots which are oriented axially and perpendicular to each other, see FIG. 2*a*. Centrally the resilient portion is provided with a bore 17.

Figure 3:
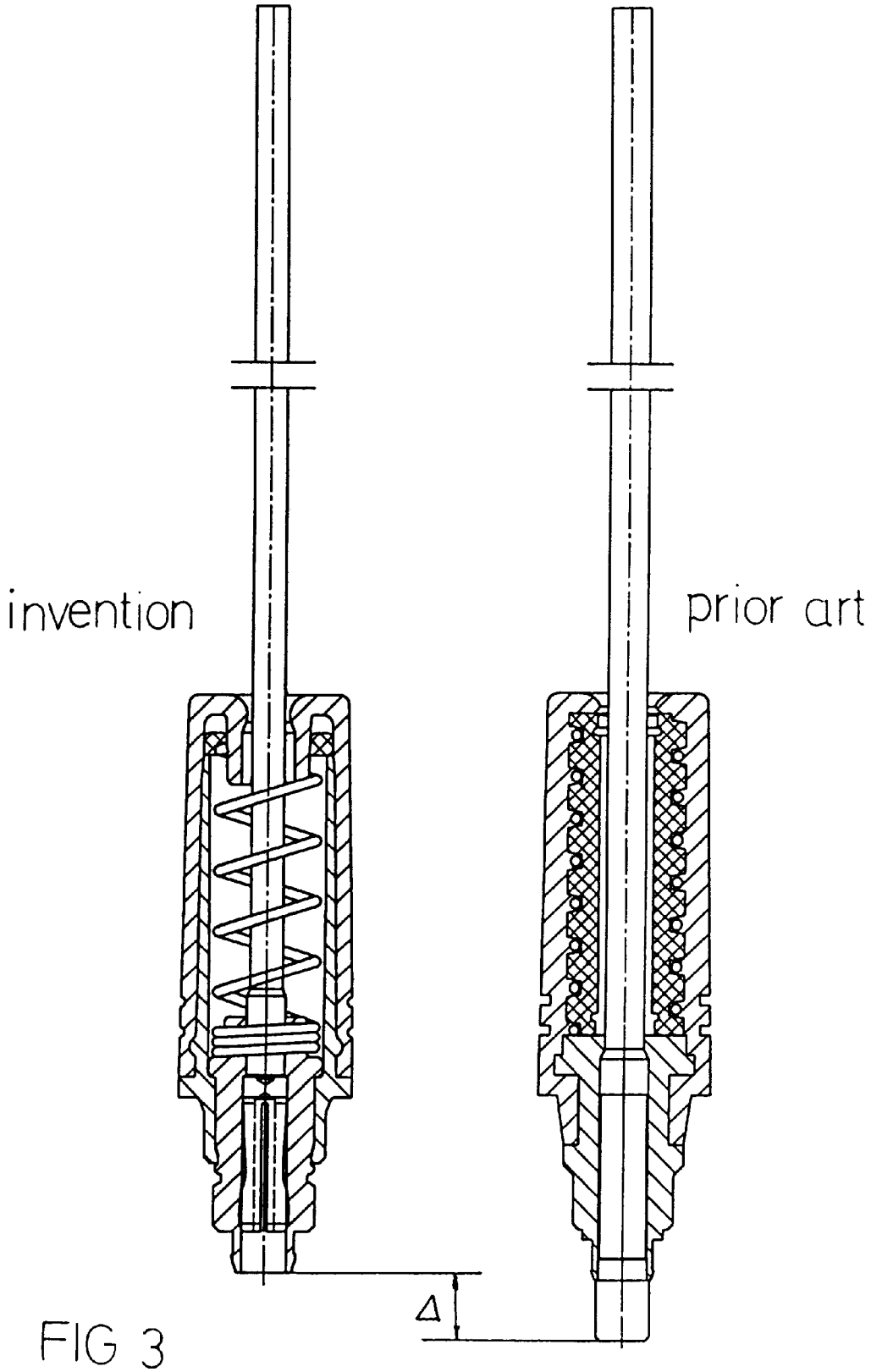

In FIG. 3, the axial length of an assembly including a device according to the invention (left) is exemplary compared with an assembly according to the prior art (right). The total length of the assembly as a whole is in practice reduced about 12% (Δ). The axial length reduction of the sleeve-stopper/peg combination as such is almost 20%.

The invention can be modified within the scope of the claims and the invention may be used in other applications than the one shown in FIG. 1. Thus, the invention is very well suited for application at the upper end of a helix casing (such as at the upper end of casing 3 on FIG. 1) because of the reduced dimensions. The device may, of course, also be applied in portable communication equipment including an extendable antenna but with or without other arrangements of fixed second antenna elements. The second antenna element may be for example a rod, a helix or a meander element.

The elongated antenna element may include a rod or any other per se known suitable radiating element.

The peg element may be configured differently by for example having only one slot 16 and/or having the entering surface 14 formed differently, for example as a part of a conical surface. The peg element may also co-operate with a sleeve member having a shallow groove on the inside so as to achieve a snap-in like fastening function. The configuration with a circular cylindrical sleeve inner surface and engagement portion having a spherical surface such that the peg is provided with a "ball bearing" at its lower end is, however, preferred.

The abutment—shoulder 9, 9' may be placed differently on the respective elements. Even placing of the shoulder 9' on the upper side of the elements 11 of the engagement portion is possible. With respect to space reduction it is however of importance to arrange for as total as possible insertion of the peg element inside the sleeve member in the extended position of the rod. It is even within the scope of the invention that the sleeve function and the abutment function are provided on two separate elements being included in the sleeve member and that the shoulder is provided separate from the peg element, for example at the lower portion of an antenna rod.

Examples of methods of manufacturing the peg are: turning and milling, forming from a plate blank and forming from a metal tube.

What is claimed is:

1. An antenna device for portable communication equipment and comprising an extendable elongated antenna element which at its lower part comprises a peg element and which is slidable inside a sleeve member between an extended position, where the peg element is mechanically locked in the sleeve member and where simultaneously conductive contact between the sleeve member and an antenna rod is established via the peg element, and a retracted position where the peg element is free from the sleeve member, said sleeve being rigid, and said peg element being provided with a resilient portion including an engagement portion have a contact surface which in the extended position of the elongated antenna element exerts a locking force against the sleeve member, said engagement portion being provided on a free end of the peg element, said sleeve member on the inside being provided with an abutment for cooperation, in the extended position of the elongated antenna element, with a corresponding shoulder comprised on the peg element, wherein the engagement portion includes engagement elements, each being provided on an axially extended spring acting shank element.

2. The device of claim 1, wherein the resilient portion is provided with at least one bifurcating slot which is arranged in parallel with the axis of the peg element.

3. The device of claim 1, wherein the contact surface for contact against the sleeve is convex.

4. The device of claim 3, wherein the contact surface is substantially part of a sphere.

5. The device of claim 4, wherein the sleeve member is provided with a substantially cylindrical inner surface for cooperation with the contact surface and the locking force is accomplished by frictional engagement.

6. The device of claim 1, wherein the length of the shank element is about 1.5–4 times a transverse dimension of the peg element.

7. The device of claim 6, wherein each shank element is tapering towards the engagement element so as to obtain equalized bending stress in the shank element.

8. The device of claim 1, wherein the sleeve member (5) on the outside is provided with a threaded portion for cooperation with a piece of communication equipment.

9. The device of claim 1, further comprising a second antenna element which is connected to the sleeve member.

10. The device of claim 9, wherein the second antenna element is any one of a group consisting of a rod, a helix and a meander element.

11. The device of claim 1, wherein the shoulder is located on the peg element, between the contact surface and an upper part which comprises a hole for receiving the antenna rod.

12. A peg element for fastening to the lower part of an extendable elongated antenna element and having an engagement portion at its free and opposite the position of a fastened antenna rod, said peg element being provided with a resilient portion including the engagement portion which has a contract surface which in the extended position of the elongated antenna element is intended to exert a locking force against the inside of a substantially rigid sleeve member, said peg element being provided with a shoulder for cooperation, in the extended position, with a corresponding abutment inside the sleeve member, said engagement portion being provided on a free end of the peg, element, and including engagement elements, each being provided on an axially extended spring acting shank element, and wherein the shoulder is located between the contact surface and an upper part which comprises a hole for receiving the antenna rod.

13. An antenna device for portable communication equipment comprising:

an elongated antenna element having upper and lower portions, a sleeve member through which said elongated antenna element is axially slidable between an extended and a retracted position, said sleeve including a generally cylindrical conductive feed portion, said antenna element having at said lower portion a conductive peg element for electrically and frictionally engaging said conductive feed portion when said antenna element is in its extended position, and the electrical and frictional engagement being broken by the peg element being free of the sleeve when retracted, said peg element being provided with an antenna element connection portion and a resilient portion formed in said peg element by at least one bifurcating slot in parallel with a longitudinal axis of the peg element, said resilient portion having at least one engagement portion with a contact surface, said electrical and frictional engagement being achieved by said contact surface exerting a contact force against said feed portion, said engagement portion being provided on a free end of the peg element, and wherein the engagement portion includes at least one engagement element which is provided on an axially extended spring acting shank element.

14. The device of claim 13, wherein the resilient portion is provide with at least one bifurcating slot which is arranged in parallel with the axis of the peg element.

15. The device of claim 13, wherein the contact surface for contact against the sleeve is convex.

16. The device of claim 15, wherein the contact surface is substantially part of a sphere.

17. The device of claim 16, wherein the sleeve member is provided with a substantially cylindrical inner surface for cooperation with the contact surface and the locking force is accomplished by frictional engagement.

18. The device of claim 13, wherein the engagement portion includes at least one engagement element which is provided on an axially extended spring acting shank element.

19. The device of claim 18, wherein the length of the shank element is about 1.5–4 times a transverse dimension of the peg element.

20. The device of claim 16, wherein each shank element is tapering towards the engagement element so as to obtain equalized bending stress in the shank element.

21. The device of claim 13, wherein the sleeve member on the outside is provided with a threaded portion for cooperation with a piece of communication equipment.

22. An antenna device for portable communication equipment comprising:

an elongated antenna element having upper and lower portions, a sleeve member through which said elongated antenna element is axially slidable between an extended and a retracted position, said sleeve including a generally cylindrical conductive feed portion, said antenna element having at said lower portion a conductive peg element for electrically and frictionally engaging said conductive feed portion when said antenna element is in its extended position, said peg element being provided with an antenna element connection portion and a resilient portion formed in said peg element by at least one bifurcating slot in parallel with a longitudinal axis of the peg element, said resilient portion having at least one engagement portion with a contact surface, said electrical and frictional engagement being achieved by said contact surface exerting a contact force against said feed portion, said engagement portion being provided on a free end of the peg element, wherein the engagement portion includes at least one engagement element which is provided on an axially extended spring acting shank element, and a second antenna element which is connected to the sleeve member.

23. The device of claim 22, wherein the second antenna element is any one of a group consisting of a rod, a helix and a meander element.

24. An antenna device, for a radio communication device, comprising:

an extendable/retractable radiating antenna rod element, a peg element which arranged at one end portion of the rod element, and a sleeve member inside which the rod element is slidable between an extended position and a retracted position, wherein the peg element being mechanically locked in the sleeve member when the rod element is in the extended position, conductive contact between at least a portion of the sleeve member and the antenna rod is established via the peg element when the rod element is in the extended position, said conductive contact is broken when the rod element is in the retracted position, said sleeve being rigid, said peg element being provided with a resilient portion including an engagement portion which in the extended position of the antenna rod element exerts a locking force against the sleeve member, said sleeve member being provided with an abutment for cooperation, in the extended position of the elongated antenna element, with a corresponding shoulder comprised on the peg element, and wherein the engagement portion includes contact surfaces and engagement elements, each being provided on an axially extended spring acting shank element.

25. The device of claim 24, wherein the resilient portion is provided with at least one bifurcating slot which is arranged in parallel with the axis of the peg element.

26. The device of claim 24, wherein at least one contact surface for contact against the sleeve is convex.

27. The device of claim 26, wherein said at least one contact surface is substantially part of a sphere.

28. The device of claim 27, wherein the sleeve member is provided with a substantially cylindrical inner surface for cooperation with the contact surfaces and the locking force is accomplished by frictional engagement.

29. The device of claim 24, wherein the length of the shank elements are about 1.5–4 times a transverse dimension of the peg element.

30. The device of claim 29, wherein each shank element is tapering towards the engagement element so as to obtain equalized bending stress in the shank element.

31. The device of claim 24, wherein the sleeve member on the outside is provided with a threaded portion for cooperation with a piece of communication equipment.

32. The device of claim 24, further comprising a second antenna element which is connected to the sleeve member.

33. The device of claim 32, wherein the second antenna element is any one of a group consisting of a rod, a helix and a meander element.

34. The device of claim 24, wherein the shoulder is located on the peg element, between the contact surface and an upper part which comprises a hole for receiving the antenna rod.

35. A stopper for fastening to the lower part of an extendable/retractable radiating antenna rod element, comprising:

a reception portion for the reception of the rod element, an engagement portion, a resilient portion including the engagement portion which has contact surfaces which in the extended position of the elongated antenna element are intended to exert a locking force against the inside of a substantially rigid sleeve member, and a shoulder for cooperation, in the extended position, with a corresponding abutment inside the sleeve member, wherein the stopper is arranged to establish conductive contact between at least a portion of the sleeve member and the antenna rod when the rod element is in the extended position, said engagement portion being provided at an end of the stopper, and including said contact surfaces arranged on engagement elements, each being provided on an axially extended spring acting shank element, and wherein the shoulder is located between the contact surface and an upper part which comprises a hole for receiving the rod element.

36. A peg element for fastening to the lower part of an extendable elongated antenna element and having an engagement portion at its free and opposite the position of a fastened antenna rod, said peg element being provided with a resilient portion including the engagement portion which has a contact surface which in the extended position of the elongated antenna element is intended to exert a locking force against the inside of a substantially rigid sleeve member, and the engagement being broken by the peg element being free of the sleeve member when retracted, said peg element being provided with a shoulder for cooperation, in the extended position, with a corresponding abutment inside the sleeve member, and said engagement portion being provided on a free end of the peg element, and including engagement elements, each being provide on an axially extended spring acting shank element.

* * * * *

US006208301C1

(12) EX PARTE REEXAMINATION CERTIFICATE (5085th)

United States Patent

Sandgren et al.

(10) Number: US 6,208,301 C1

(45) Certificate Issued: Mar. 15, 2005

(54) ANTENNA DEVICE

(75) Inventors: Anders Sandgren, Djursholm (SE); Magnus Bjornberg, Ljustero (SE); Ulf Palin, Ljustero (SE); Carl Jonasson, Stockholm (SE)

(73) Assignee: Allgon AB, Akersberga (SE)

Reexamination Request:
No. 90/006,282, May 8, 2002

Reexamination Certificate for:

| | |
|---|---|
| Patent No.: | **6,208,301** |
| Issued: | **Mar. 27, 2001** |
| Appl. No.: | **09/477,018** |
| Filed: | **Jan. 3, 2000** |

Related U.S. Application Data

(63) Continuation of application No. 09/007,812, filed on Jan. 15, 1998, now abandoned.

(51) Int. Cl.[7] ..... H01Q 1/24

(52) U.S. Cl. ..... 343/702; 455/90.3

(58) Field of Search ..... 343/702; 455/575.1, 455/90.3

(56) References Cited

U.S. PATENT DOCUMENTS

| | | | | |
|---|---|---|---|---|
| 4,325,069 | A | 4/1982 | Hills | 343/750 |
| 5,079,558 | A | 1/1992 | Koike | 343/702 |
| 5,353,036 | A | 10/1994 | Baldry | 343/702 |
| 5,389,938 | A | 2/1995 | Harrison | 343/702 |
| 5,521,605 | A | 5/1996 | Koike | 343/702 |
| 6,034,639 | A | 3/2000 | Rawlins et al. | 343/702 |

*Primary Examiner*—Tan Ho

(57) ABSTRACT

An antenna device (1) for portable communication equipment and comprising an extendable elongated antenna element (2) which at its lower part comprises a peg element (6) and which is slidable inside a sleeve (5) between an extended position and a retracted position, wherein the sleeve (5) is rigid and the peg element (6) is provided with a resilient engagement portion at a free end of the peg element, said sleeve (5) on the inside being provided with an abutment (9) for co-operation with a corresponding shoulder (9') on the elongated antenna element (6), said shoulder being located between the contact surface and the upper end of the elongated antenna element.

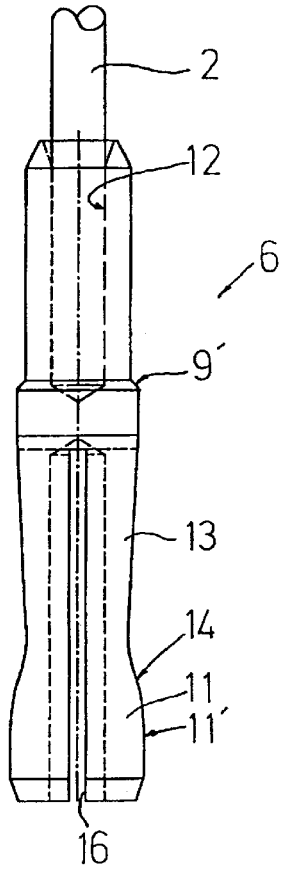

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–36 is confirmed.

* * * * *